US010215518B1

(12) United States Patent
Kramer

(10) Patent No.: US 10,215,518 B1
(45) Date of Patent: Feb. 26, 2019

(54) CARTRIDGE EXTRACTOR FOR FIREARMS

(71) Applicant: Lawrence S. Kramer, Las Vegas, NV (US)

(72) Inventor: Lawrence S. Kramer, Las Vegas, NV (US)

(73) Assignee: Kramer Cartridge & Carbine LLC, Las Vegas, NV (US)

( * ) Notice: Subject to any disclaimer, the term of this patent is extended or adjusted under 35 U.S.C. 154(b) by 0 days.

(21) Appl. No.: 15/722,548

(22) Filed: Oct. 2, 2017

(51) Int. Cl.
*F41A 15/12* (2006.01)
*F41C 7/00* (2006.01)

(52) U.S. Cl.
CPC ..... *F41A 15/12* (2013.01); *F41C 7/00* (2013.01)

(58) Field of Classification Search
CPC ..... F41A 15/12; F41A 15/14; F41A 15/16; F41C 7/00
USPC ..... 42/25, 46, 68
See application file for complete search history.

(56) References Cited

U.S. PATENT DOCUMENTS 3,696,542 A * 10/1972 Ekfeldt ..... F41A 15/14 42/16
4,272,902 A * 6/1981 Waters ..... F41A 15/14 42/25
5,911,173 A * 6/1999 Westrom ..... F41A 15/12 89/185
6,484,430 B1 * 11/2002 Robinson ..... F41A 3/26 42/25
9,234,713 B1 * 1/2016 Olson ..... F41A 15/14
2007/0193101 A1 * 8/2007 Shimi ..... F41A 3/66 42/46
2008/0092733 A1 * 4/2008 Leitner-Wise ..... F41A 3/26 89/138
2011/0005383 A1 * 1/2011 Kramer ..... F41A 5/18 89/191.01
2013/0219763 A1 * 8/2013 Nunes ..... F41A 3/66 42/16
2014/0075806 A1 * 3/2014 Blank ..... F41A 3/26 42/25
2014/0075807 A1 * 3/2014 Lewis ..... F41A 15/14 42/25
2014/0090283 A1 * 4/2014 Gomez ..... F41A 3/26 42/25

OTHER PUBLICATIONS

Author unknown, 7.62×51mm NATO, found Mar. 31, 2018, Internet document published by Wikipedia, 1-13, found here: https://en.wikipedia.org/wiki/7.62%C3%9751mm_NATO (Year: 2018).*

* cited by examiner

*Primary Examiner* — Bret Hayes
(74) *Attorney, Agent, or Firm* — Patterson & Sheridan, LLP

(57) ABSTRACT

The present disclosure generally relates to extractors for extracting cartridges from firearms, as well as bolts including the extractors, and barrels or barrel extensions configured to receive the bolts and extractors. The extractor includes a support brace having a width greater than 0.095 inches. A barrel extension includes a shortened lug to accommodate an extractor having a support brace with a width greater than 0.095 inches.

12 Claims, 4 Drawing Sheets

CARTRIDGE EXTRACTOR FOR FIREARMS

BACKGROUND

Field

Embodiments of the present disclosure relate to a cartridge extractor for firearms, such as a cartridge extractor used on a bolt of an AR15/M4 type firearm system. Embodiments of the present disclosure also relate to a modified barrel extension to accept the disclosed extractor.

Description of the Related Art

Firearms such as the AR15/M4 firearm system use a rotating bolt with seven lugs. The bolt has an extractor connected thereby by a pivoting connection to "extract" the fired cartridge case from the chamber of the firearm after the cartridge has been fired.

Conventional AR15/M4 type extractors work well but are limited in design due to limited operating space of an established and defined platform. Conventional AR15/M4 type extractors provide adequate service life when used in the original firearm which the conventional extractors were designed for: the M16 rifle. The M16 rifle has a twenty inch barrel and uses a rifle length gas system, which allows most of the pressure in the barrel and chamber to drop to a level that allows the extractor to easily extract the fired case from the chamber. The desire for M16 type rifles with shorter barrels to increase manipulation inside of vehicles, helicopters and buildings led to the development of the 14.5" barreled M4 carbine and the 10.5" barreled Mark 18 Colt Commando. These two firearms use a shorter "carbine" length gas system which pressurizes the gas system sooner and faster than the longer rifle length system, resulting in a greater pressure "spike".

When the operating system pressurizes earlier, the bolt carrier begins to move rearward unlocking the bolt before the chamber pressure has dropped to an appropriate level. When the bolt carrier begins moving before chamber pressure drops to an adequate level, the extractor attempts to extract the fired case while the fired case is still under pressure in the chamber. Conventional extractors are not designed to extract pressurized cartridge cases. The repeated extracting of fired cases under pressure overworks the extractor and leads to early extractor failure. Extractors typically break in the same place, the top of the extractor's claw, where most of the force is applied when a cartridge is extracted from the chamber.

Another issue created when the extractor extracts a fired cartridge case while the cartridge case is still under pressure is that the extractor will pull off of or snap back off of the rim of the case, leaving the fired case in the chamber and thus causing the firearm to malfunction. When this happens, the extractor may occasionally rip off a portion of the cartridge case rim, requiring a cleaning rod to be inserted into the muzzle of the barrel to force out the fired case. When a cartridge fails to be extracted, the firearm becomes disabled and cannot be used, thus creating a critical issue for military and law enforcement officers who may be in a life threatening situation. Moreover, each time the extractor snaps off the rim of the case without extracting the case, undue stress is put on the claw portion of the extractor, contributing to early extractor failure. Attempts to solve these issues have led to extractors with stronger springs, and to some barrels with pins installed in the barrel extension to prevent the extractor from pulling off of the cartridge case rim during extraction. However, these attempts have provided only moderate improvements.

What is needed is an improved cartridge extractor for firearms.

SUMMARY

The present disclosure generally relates to extractors for extracting cartridges from firearms, as well as bolts including the extractors, and barrels or barrel extensions configured to receive the bolts and extractors. The extractor includes a support brace having a width of 0.095 inches or greater. A barrel extension includes a shortened lug to accommodate an extractor having a support brace with a width of 0.095 inches or greater.

In one aspect, a cartridge extractor for a firearm comprises a body having a curved outer surface and a curved inner surface; a bevel formed at one end of the body on the curved inner surface; a support brace positioned proximate to the bevel, the support brace formed on the curved outer surface, the support brace having a width of 0.095 inches or greater.

In another aspect, a bolt for a firearm comprises bolt body; and a cartridge extractor disposed in a recess formed in the bolt body. The cartridge extractor comprises a body having a curved outer surface and a curved inner surface; a bevel formed at one end of the body on the curved inner surface; a support brace positioned proximate to the bevel, the support brace formed on the curved outer surface, the support brace having a width of 0.095 inches or greater.

In another aspect, a barrel extension for a barrel comprises a body having a central opening therein; and a plurality of lugs extending from a radially inward surface of the body, wherein one lug of the plurality of lugs is located about −120 degrees from a center line of a two feed ramps, and wherein the one lug has a radial length less than a radial length of remaining lugs of the plurality of lugs.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally relates to extractors for extracting cartridges from firearms, as well as bolts including the extractors, and barrels or barrel extensions configured to receive the bolts and extractors. The extractor includes a support brace having a width of 0.095 inches or greater. A barrel extension includes a shortened lug to accommodate an extractor having a support brace with a width of 0.095 inches or greater.

Figure 1A:
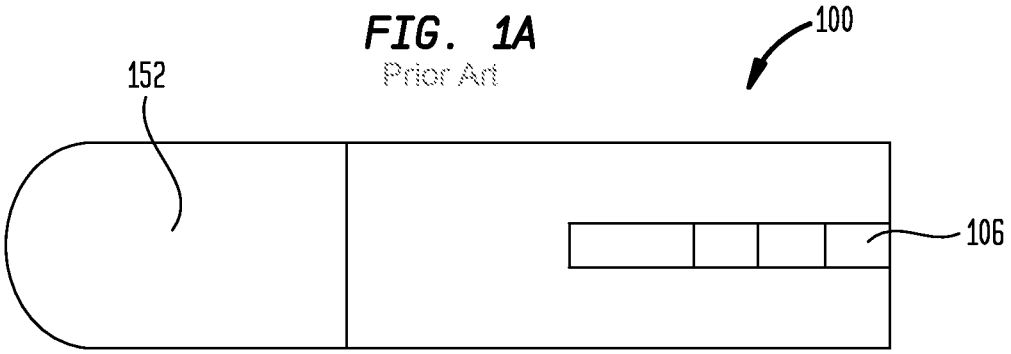
FIG. 1A Prior Art
FIG. 1A is a schematic top plan view of a conventional extractor.
Figure 1B:
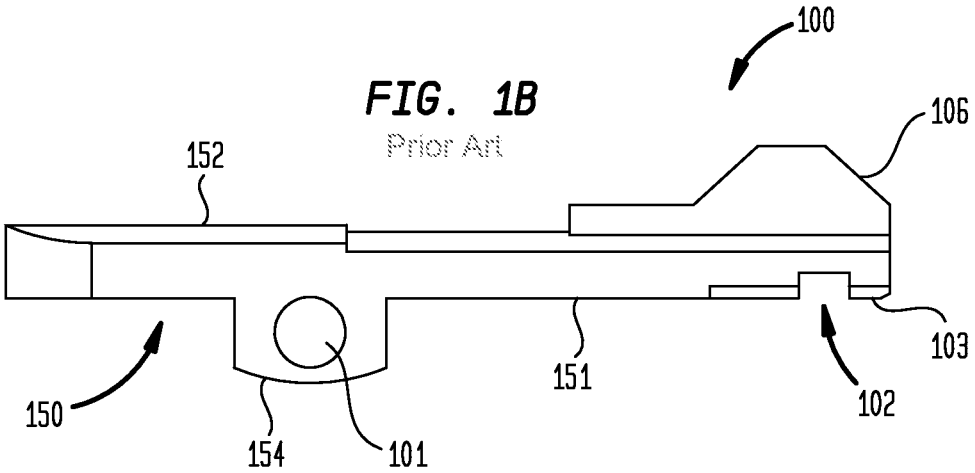
FIG. 1B Prior Art
FIG. 1B is a schematic side view of a conventional extractor.
Figure 1C:
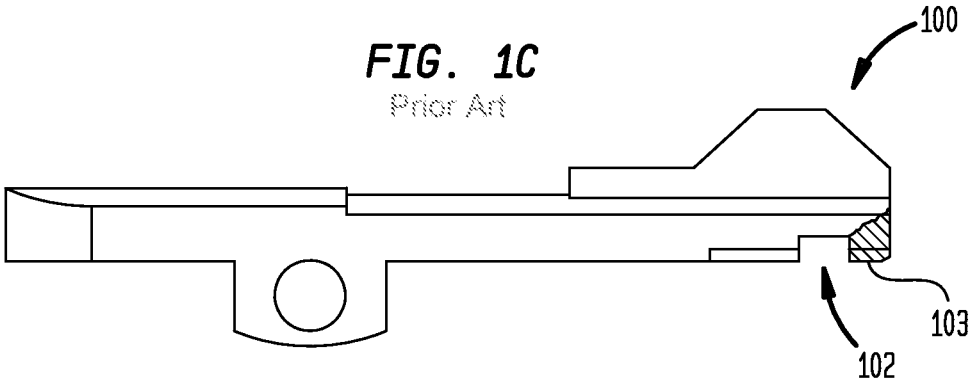
FIG. 1C Prior Art
FIG. 1C is a schematic side view of a conventional extractor having a broken extractor claw.

FIGS. 1A-1C are schematic illustrations of a conventional extractor 100. The extractor 100 includes a body 150 having an inner surface 151 and an outer surface 152. The inner surface 151 and the outer surface 152 may each be rounded or curved along the longitudinal axis of the extractor 100. The extractor 100 includes a radially-inward bevel 102 on a front portion of the extractor 100 on the inner surface 151 thereof. The radially-inward bevel 102 is partially defined by a claw 103. A support brace 106 is positioned proximate to the radially-inward bevel 102 on the outer surface 152. The support brace 106 is configured to reduce breakage of the claw 103. However, conventional extractors 100 still suffer from breakage at the claw 103, as shown in FIG. 1C, particularly when removing cartridges in firearms with carbine- or pistol-length gas systems.

The extractor 100 sits in a recess formed in a side of the bolt and is retained therein with a cross pin through an opening 101 formed in an extension 154 on the inner surface 151 of the extractor 100. The cross pin holds the extractor 100 in place in the bolt and also defines a pivot point about which the extractor 100 pivots when the firearm cycles.

Figure 2A:
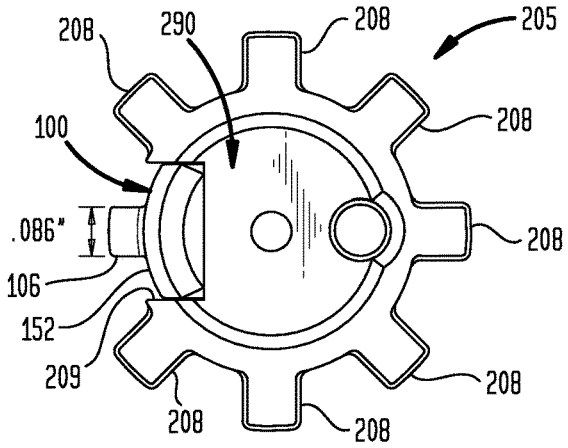
FIG. 2A Prior Art
FIG. 2A is a schematic front view of a bolt having a conventional extractor installed.
Figure 2B:
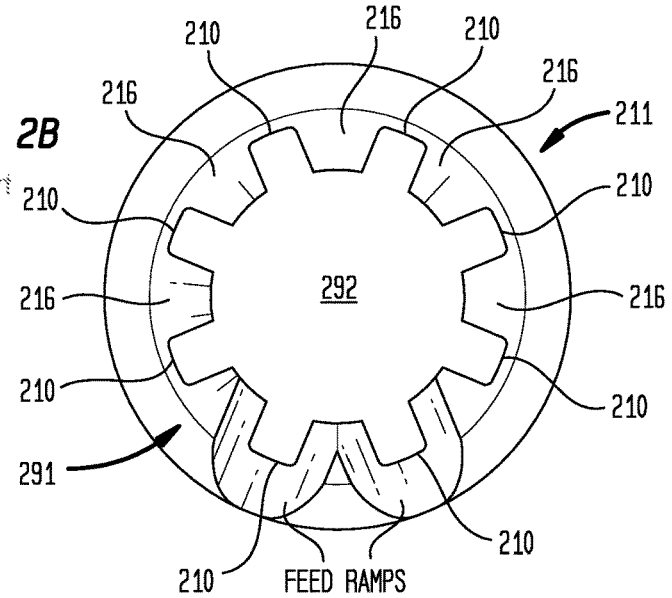
FIG. 2B Prior Art
FIG. 2B schematically illustrates a conventional barrel extension.
Figure 2C:
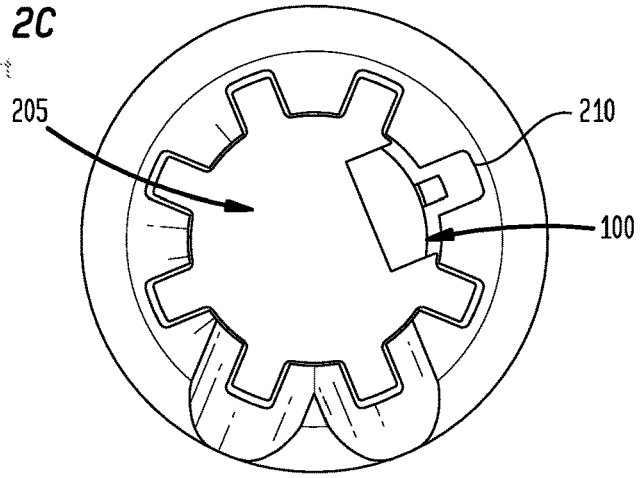
FIG. 2C Prior Art
FIG. 2C is a schematic rear view of a conventional bolt as the bolt passes through a barrel extension during cycling of the firearm.

FIG. 2A is a schematic front view of a bolt 205 having a conventional extractor 100 installed. FIG. 2B schematically illustrates a conventional barrel extension 211, which may be engaged by the bolt 205. FIG. 2C is a schematic rear view of a bolt 205 as the bolt 205 passes through a barrel extension 211 during cycling of the firearm.

The bolt 205 includes a bolt body 290 having a plurality of lugs 208 (seven are shown) disposed therearound in spaced intervals. The bolt body 290 also includes a recess 209 into which the extractor 100 is positioned. In one example, the support brace 106 of the extractor 100 is a raised ridge extending axially along a portion of the outer surface 152 of the extractor. The support brace 106 has a width of 0.086 inches. The support brace 106 on the back of the extractor 100 provides support to strengthen the extractor claw 103 (shown in FIG. 1B).

During operation, when the bolt 205 is released from a locked open position, the bolt 205 moves forward and strips or picks up a cartridge from a magazine. The cartridge moves forward and is guided into the chamber by feed ramps located on the barrel extension 211. As the cartridge enters the chamber, the bolt 205 continues pushing the cartridge forward. As the cartridge becomes seated in the chamber and stops moving forward, a radially-inward bevel 102 (shown in FIG. 1B) engages a rim of the cartridge via outward pivoting deflection of the extractor 100. Outward deflection of the extractor 100 occurs by pivoting about the cross pin, thus allowing the bevel 102 of the extractor 100 to snap over the rim of a cartridge. Upon engagement, the bolt rotates into a locked position within the barrel extension.

The support brace 106 on the back of the extractor 100 passes through one of the bolt lug recesses 210 (eight are shown) formed in the barrel extension 211, as the firearm cycles. The barrel extension 211 includes a body 291 having a central opening 292 formed therein. Extension lugs 216 extend radially inward from an inner surface of the body 291. Adjacent extension lugs 216 define the bolt lug recesses 210. FIG. 2C is a schematic rear view of a bolt 205 with an extractor 100 as the bolt 205 passes through a barrel extension 211. The width of the support brace 106 on the extractor 100 is 0.086 inches wide, which provides ample clearance on both sides of the brace 106 to clear a respective lug recess 210 in the barrel extension 211 as the bolt 205 passes through and locks into the barrel extension 211 during operation. Clearance between sidewalls of the lug recess 210 and the extractor 100 facilitates operational reliability of the firearm.

When the bolt 205 closes and locks into the barrel extension 211, the bolt 205 rotates counter clockwise 22.5 degrees. Once the bolt 205 comes to rest in a completely locked position, the bolt extractor 100 rests adjacent a barrel extension lug 216 located at the two o'clock position (when viewed from the rear). The extension lug 216 in the two o'clock position on a conventional barrel extension 211 is unused by a conventional bolt 205, and no forces are applied to the extensions lug 216 in the two o'clock position by the conventional bolt 205.

Figure 3A:
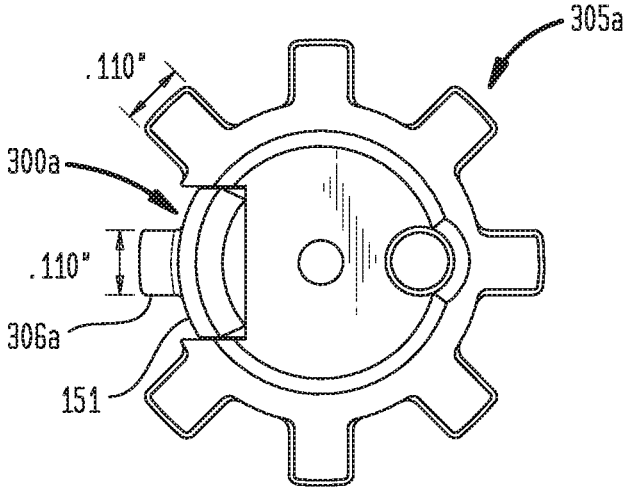
FIG. 3A is a schematic front view of a bolt with an extractor of the present disclosure installed.

FIG. 3A is a schematic front view of a bolt **305*a* with an extractor 300*a* of the present disclosure installed. The bolt 305*a* is similar to the bolt 205, but includes the extractor 300*a* rather than a conventional extractor 100. The extractor 300*a* includes a support brace 306*a* located on an outer surface 152 thereof. The support brace 306*a* has a width of 0.110 inches (compared to 0.086 inches of the support brace 106) to match the width of a standard bolt lug 208 (e.g., 0.110 inches). By increasing the width of the support brace 106 to 0.110 inches (e.g., 0.055 inches each side from center, accomplished by adding 0.012 inches to each side of the support brace 106), the width of the support brace 306*a* is increased approximately twenty eight percent in comparison to the support brace 106. However, even with the increased width, the support brace 306*a* is able to pass through the existing bolt lug recess 210 in the barrel extension 211. Thus, in one example, the bolt 305*a* having the extractor 300*a* may operate in a firearm having a conventional barrel extension 211, without any modification thereto. The increased width of the support brace 306*a* relative to a conventional support brace 106 provides additional support to the extractor 300*a*** in an area of typical failure, thus resulting in a reduced failure rate compared to conventional extractors.

Figure 3B:
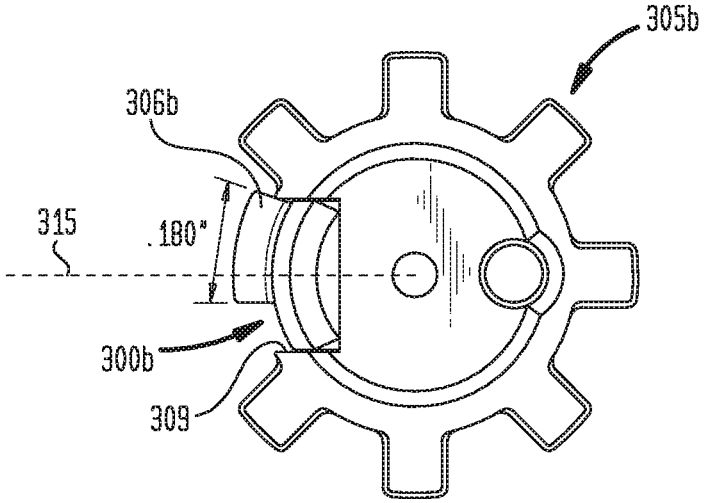
FIG. 3B is a schematic front view of the bolt with an extractor of the present disclosure, according to another embodiment.

FIG. 3B is a schematic front view of the bolt **305*b* with an extractor 300*b* of the present disclosure, according to another embodiment. The bolt 305*b* and the extractor 300*b* are similar to the bolt 305*a* and the extractor 300*a*, except that the extractor 300*b* includes a support brace 306*b*. The support brace 306*b* has a width of 0.180 inches. In the illustrated example, the support brace 306*b* extends approximately to a lateral edge of the extractor 300*b*. In such an example, a sidewall of the support brace 306*b* is positioned adjacent a sidewall of a recess 309 in the bolt 305*b*. In such an example, a clearance between the sidewall of the support brace 306***b* and the sidewall of the recess 309 is about 0.002 inches, +/−0.001 inches. In one example, the support brace 306*b* is off-centered with respect to the longitudinal (or axial) centerline 315 of the extractor 300*b*. In such an example, about 0.055 inches of the support brace 306*b* is on a first side of the centerline 315, and about 0.125 inches of the support brace is on a second side of the centerline 315. The increased width of the support brace 306*b* relative to the support brace 306*a* promotes even greater structural integrity.

Figure 3C:
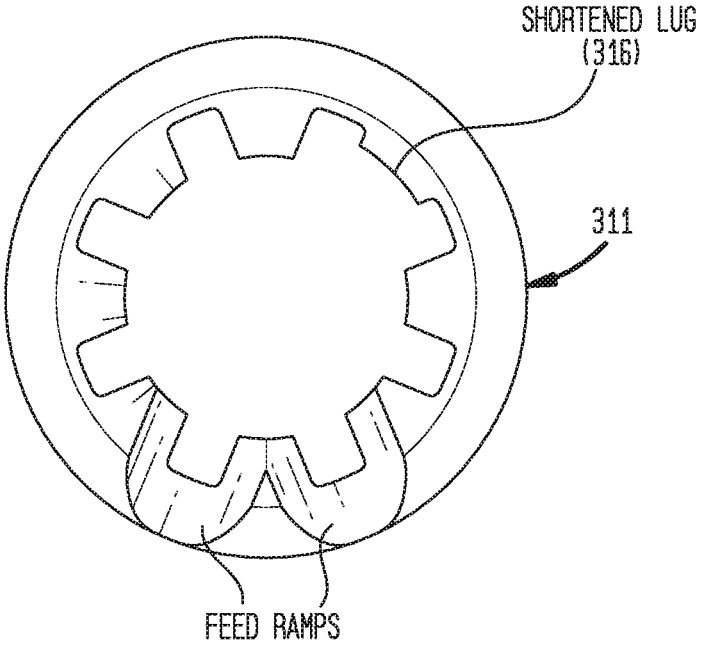
FIG. 3C schematically illustrates a barrel extension, according to one aspect of the disclosure.
Figure 3D:
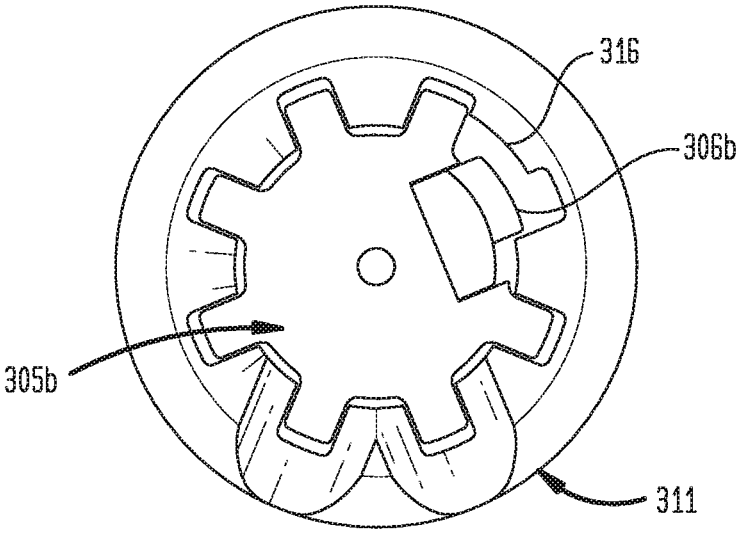
FIG. 3D is a schematic rear view of a bolt of the present disclosure as the bolt passes through a barrel extension.

FIG. 3C schematically illustrates a barrel extension 311, according to one aspect of the disclosure. To accommodate the bolt 305*b* having the extractor 300*b* thereon, a lug 316, which is disposed at the 2 o'clock position with respect to the feed ramps (e.g., about −120 degrees relative to a center of the feed ramps), is shortened to accommodate the support brace 306*b*. As discussed above, during operation of a conventional bolt, no forces are applied to the lug in the two o'clock position. Thus, shortening of the 2 o'clock lug, as illustrated by lug 316, does not negatively affect firearm operation, but provides sufficient clearance for an enlarged support brace 306*b*, as illustrated in FIG. 3D. In one example, the 2 o'clock lug may have a length of 70 percent or less than the other lugs, such as about 60 percent to about 10 percent, or about 50 percent to about 20 percent. In one example, the 2 o'clock lug may be completely removed.

FIG. 3D is a schematic rear view of a bolt 305*b* of the present disclosure as the bolt 305*b* passes through a barrel extension 311. As illustrated, the extractor 306*b* is positioned adjacent to the lug 316 (e.g., the 2 o'clock lug), which has a larger internal diameter (or radius to a radially inward surface thereof) than that of the remaining lugs. The decreased length of the lug 316 accommodates the support brace 306*b*, which is larger than conventional support braces, and therefore provides additional strength to the extractor 300*b* to mitigate breakage thereof.

In disclosed examples, it is contemplated that support braces disclosed herein have a width of 0.095 inches or greater, such as 0.098 inches or greater, or within a range of 0.098 inches to 0.180 inches.

It is contemplated that support braces disclosed herein, and barrel extensions corresponding thereto, are applicable to bolts and extractors disclosed in U.S. Pat. No. 8,695,260, such as extractors shown and described with respect to FIGS. 4A and 4B. U.S. Pat. No. 8,695,260 is incorporated herein in its entirety to the extent not inconsistent with this disclosure.

Benefits of the present disclosure include a strengthened extractor claw. The strengthened extractor claw is supported by a supported brace having an increased mass due to an increased width. Increasing the width of the existing extractor brace increases the mass in the area where the extractors most often fail. The disclosed extractor is stronger than conventional extractors, and is adaptable to the currently issued M16A4/M4 carbine and similar firearms.

While the foregoing is directed to embodiments of the present disclosure, other and further embodiments of the disclosure may be devised without departing from the basic scope thereof, and the scope thereof is determined by the claims that follow.

What is claimed is:

1. A cartridge extractor for a firearm, comprising:
- a body having a curved inner surface and a curved outer surface;
- a bevel formed at one end of the body on the curved inner surface;
- a support brace positioned proximate to the bevel, the support brace formed on the curved outer surface and being positioned intentionally off center relative to a longitudinal centerline of the body, the support brace having a width greater than 0.095 inches.

2. The cartridge extractor of claim 1, wherein the support brace has a width of 0.098 inches or greater.

3. The cartridge extractor of claim 1, wherein the support brace has a width between 0.098 inches and 0.180 inches.

4. The cartridge extractor of claim 1, wherein the support brace has a width of 0.180 inches.

5. The cartridge extractor of claim 1, wherein about 0.055 inches of the support brace is on a first side of the longitudinal centerline and about 0.125 inches is on a second side of the longitudinal centerline.

6. A bolt for a firearm, comprising:
- a bolt body; and
- a cartridge extractor disposed in a recess formed in the bolt body, the cartridge extractor comprising:
  - a body having a curved outer surface and a curved inner surface;
  - a bevel formed at one end of the body on the curved inner surface;
  - a support brace positioned proximate to the bevel, the support brace formed on the curved outer surface and being positioned intentionally off center relative to a longitudinal centerline of the body, the support brace having a width of 0.095 inches or greater.

7. The bolt of claim 6, wherein the support brace has a width of 0.098 inches or greater.

8. The bolt of claim 6, wherein the support brace has a width between 0.098 inches and 0.180 inches.

9. The bolt of claim 6, wherein the support brace has a width of 0.180 inches.

10. The bolt of claim 6, wherein about 0.055 inches of the support brace is on a first side of the longitudinal centerline and about 0.125 inches is on a second side of the longitudinal centerline.

11. The bolt of claim 6, further comprising a plurality of lugs disposed around the bolt body in spaced intervals.

12. A firearm kit, comprising:
- the bolt of claim 6; and
- a barrel extension for a barrel, the barrel extension comprising:
  - a body having a central opening therein; and
  - a plurality of lugs extending from a radially inward surface of the body, wherein one lug of the plurality of lugs is located about −120 degrees from a center line of a two feed ramps, and wherein the one lug has a radial length less than a radial length of remaining lugs of the plurality of lugs.

* * * * *